US006009783A

United States Patent [19]

Taijonlahti et al.

[11] Patent Number: 6,009,783

[45] Date of Patent: Jan. 4, 2000

[54] METHOD IN A SHEET METAL WORK CENTER AND A SHEET METAL WORK CENTER

[75] Inventors: Jorma Taijonlahti, Yliharma; Mikael Ollikainen, Lappeenranta, both of Finland

[73] Assignee: Lillbacka Jetair Oy, Kauhava, Finland

[21] Appl. No.: 08/894,128

[22] PCT Filed: Nov. 19, 1996

[86] PCT No.: PCT/FI96/00624

§ 371 Date: Dec. 12, 1997

§ 102(e) Date: Dec. 12, 1997

[87] PCT Pub. No.: WO97/21502

PCT Pub. Date: Jun. 19, 1997

[30] Foreign Application Priority Data

Dec. 14, 1995 [FI] Finland ..... 955987

[51] Int. Cl.[7] ..... B26D 7/00

[52] U.S. Cl. ..... 83/124; 83/125; 83/126; 83/621; 72/347; 72/351

[58] Field of Search ..... 72/347, 351, 344, 72/401; 83/124, 125, 126, 175, 389, 621, 690

[56] References Cited

U.S. PATENT DOCUMENTS

| | | | |
|---|---|---|---|
| 694,892 | 3/1902 | Reynolds | 72/347 X |
| 1,354,785 | 10/1920 | Strand | 72/351 X |
| 1,550,387 | 8/1925 | Nilson et al. | 72/351 X |
| 1,849,670 | 3/1932 | Glasner et al. | 72/347 X |
| 2,123,683 | 7/1938 | Oeckl | 153/48 |
| 3,667,305 | 6/1972 | Rasoira | 74/818 |
| 3,949,631 | 4/1976 | Goldman et al. | 83/124 X |
| 4,267,753 | 5/1981 | Bennett | 83/124 |
| 4,387,583 | 6/1983 | Martin et al. | 72/22 |
| 4,574,608 | 3/1986 | Bulso, Jr. et al. | 72/347 X |
| 4,599,885 | 7/1986 | Stone | 72/347 |
| 4,601,190 | 7/1986 | Schneider et al. | 72/347 |
| 4,615,204 | 10/1986 | Yamamoto et al. | 72/347 |
| 4,672,831 | 6/1987 | Kogure et al. | 72/21 |
| 4,951,537 | 8/1990 | Bennett | 72/344 X |
| 5,052,208 | 10/1991 | Sartorio | 72/407 |
| 5,077,998 | 1/1992 | Santorio | 72/21 |
| 5,168,738 | 12/1992 | Bielfeldt | 72/351 |
| 5,247,862 | 9/1993 | Haack | 83/124 X |
| 5,349,843 | 9/1994 | Hubball | 72/344 X |
| 5,628,224 | 5/1997 | McClung et al. | 72/351 X |

FOREIGN PATENT DOCUMENTS

| | | | |
|---|---|---|---|
| 91830 | 5/1994 | Finland . | |
| 39 25 608 A1 | 2/1990 | Germany . | |
| 34 34 470 C2 | 7/1994 | Germany . | |
| 1574320 | 6/1990 | U.S.S.R. | 72/351 |

OTHER PUBLICATIONS

Japanese Abstract 57–195537 (Amanda K.K.), Dec. 1, 1992 (01.12.82), Fig. 1.

*Primary Examiner*—M. Rachuba
*Attorney, Agent, or Firm*—Louis Woo

[57] ABSTRACT

The invention relates to a sheet metal work center and a method for fabricating sheet metal therefrom. In the sheet metal work center, a locking arrangement is placed between the upper tool and a releaser, and the transfer device is arranged to consist of two parts. The sheet metal work center is adaptable to work in either a passive or active mode. In the passive mode, the releaser is positioned at a certain distance from the surface of the sheet, and the movements of the upper tool and the releaser are made with the locking arrangement locked and either part of the transfer device used. In the active mode, the releaser is positioned to be in contact with the sheet, and the movements of the upper tool and releaser are made with the locking arrangement locked and either part of the transfer device used. Working operations of the lower tool are conducted with the locking arrangement released and a part of the transfer device used, and the releaser being kept at its position by a second part of the transfer device.

15 Claims, 7 Drawing Sheets

METHOD IN A SHEET METAL WORK CENTER AND A SHEET METAL WORK CENTER

FIELD OF INVENTION

The invention relates to a method of implementing a working process at substantially the same working speed irrespective of whether an active or passive mode is used to fabricate a worksheet in a sheet metal work center.

BACKGROUND OF INVENTION

Generally in sheet metal working technology, for example in sheet punching, certain components are always needed. These include tools, punches or drifts, a releasing plate or a releaser or stripper, and a cushion. In sheet punching, the machining is conducted in a way that a punch is used to make a hole in a sheet against the cushion, and the punch is drawn out of the hole either by a spring force or by another force, wherein the releasing plate prevents the punched sheet from rising with the punch, the plate remaining in its place. In sheet punching, there are two possibilities to conduct the machining: first of all in a way that the releasing plate is in contact with the sheet to be punched during each punching stroke; or the second alternative being that there is a certain air gap between the material to be punched and the releasing plate. Each method has its own advantages, i.e., when there is a contact with the plate at the punching stage, the plate will not vibrate during machining. On the other hand, when punching aluminium or materials which are soft or have a sensitive surface, the releasing force may become too great and leave scratches on the surface of the material. Because of this, it is preferred that both alternatives be available in a sheet metal work center. Thus the releaser plate could be kept in place during the punching strokes to achieve a permanent air gap, or the releaser plate could touch the material with every punching stroke.

Known sheet metal work centres use a single-tool system having a buffer, to which the drift is mechanically fixed, wherein it can be exchanged, if necessary, either manually, by a robot or with a manipulator, and a releaser plate, wherein both are controlled with a separate pressurized medium cylinder arrangement. This kind of a solution involves, however, the problem that two separate shaft systems are required for controlling the pressurized medium, and these must be synchronized with a numerical control (NC) unit. This tends to delay the working process. The single-tool system is relatively fast in the so-called passive mode, wherein the releaser, usually a releaser plate, is stationary at the distance of an air gap from the sheet to be worked during the punching stroke. Thus the buffer, with the drift, can conduct punching strokes even at very short intervals. The problem is present particularly when the so-called active mode is used, wherein the releaser plate is placed in contact with the surface of the sheet to be worked. Thus a need for so-called serial control arises, wherein the implementation of the NC control unit requires first the information that the releaser plate is in contact with the surface of the sheet to be worked before the buffer can be given a punching command. This fact will cause a delay of about one third in the working process when moving from the passive mode to the active mode.

SUMMARY OF THE INVENTION

With the present invention, it is possible to implement the working process substantially at the same working speed irrespective of whether the active or passive mode is used, i.e. whether the releaser plate is at a distance of an air gap from the sheet to be worked or in contact with said plate. Using the solution of the invention, the above-mentioned working operations can be conducted with so-called one-shaft control. The purpose of the invention is thus to raise the standard of prior art and to present new surprising solutions for making the operations of sheet metal work centers more efficient and varied.

The method of the invention is primarily characterized in what will be presented in the characterizing part of the appended Claim 1.

The invention is also related to a sheet metal work center. Its primary characterizing features are disclosed in the characterizing part of the appended independent claim on a sheet metal work center.

The appended dependent claims disclose some advantageous embodiments of the sheet metal work center according to the invention.

BRIEF DESCRIPTION OF THE DRAWINGS

The invention will be described in more detail in the following description with reference to the embodiment shown in the appended drawings, wherein.

DETAILED DESCRIPTION OF THE INVENTION

Figure 1:
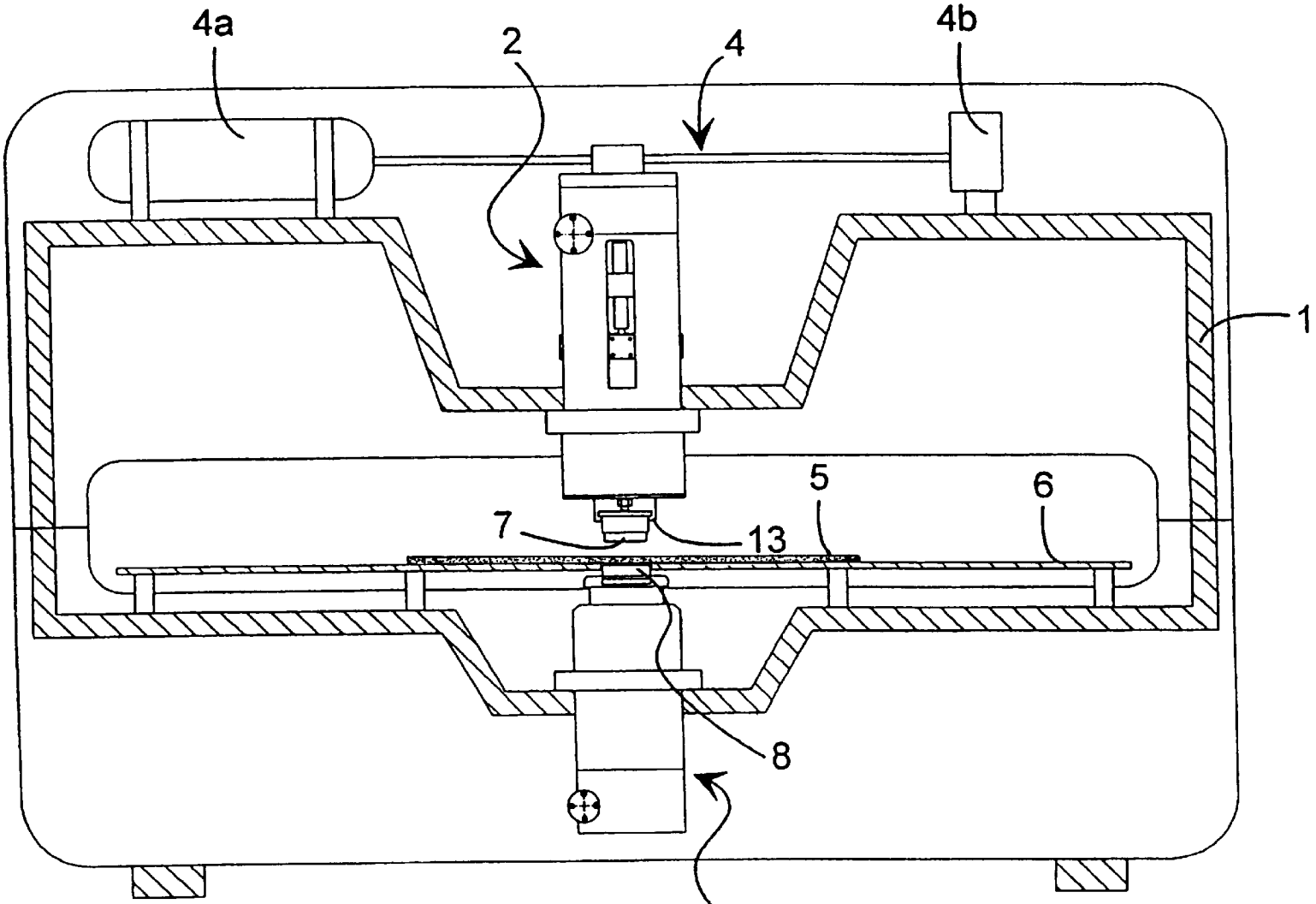
FIG. 1 is a schematic general view of a sheet metal work center according to the invention, shown in a vertical section.

With reference to FIG. 1, the reference numeral 1 indicates the machine body of the sheet metal work center, having a buffer structure 2 placed in its upper part and a stopper structure 3 placed in its lower part. The machine body has either a closed, circumferential O-structure or an open structure having e.g. a C-, J-form or the like. FIG. 1 shows also equipment related to the buffer transfer device indicated with the reference numeral 4, such as a hydraulic accumulator 4*a* and a valve block 4*b*. The sheet 5 to be worked is placed onto the work table or the machining level 6, underneath the upper tool or drift 7 and the releaser 13, and above the lower tool or stopper 8 in the stopper structure 3, between said parts 7, 13,and 8. Sheet 5 is held (fixed) and moved by means, such as for example the carriage and clamps disclosed in U.S. Pat. No. 4,658,682, along machining level 6 for processing. Such means is represented by the dotted carriage 5*a*. The sheet metal work center can be used for working at least the following operations: punching, forming, screwing, and other generally known working operations to be conducted with a sheet metal work center. Normally, the buffer structure 2 conducts the sheet punching operations with a downwards directed working movement. Alternatively, the lower tool 8 can be used for forming, wherein the working direction of the forming lower tool 8 is from below upwards.

Figure 2:
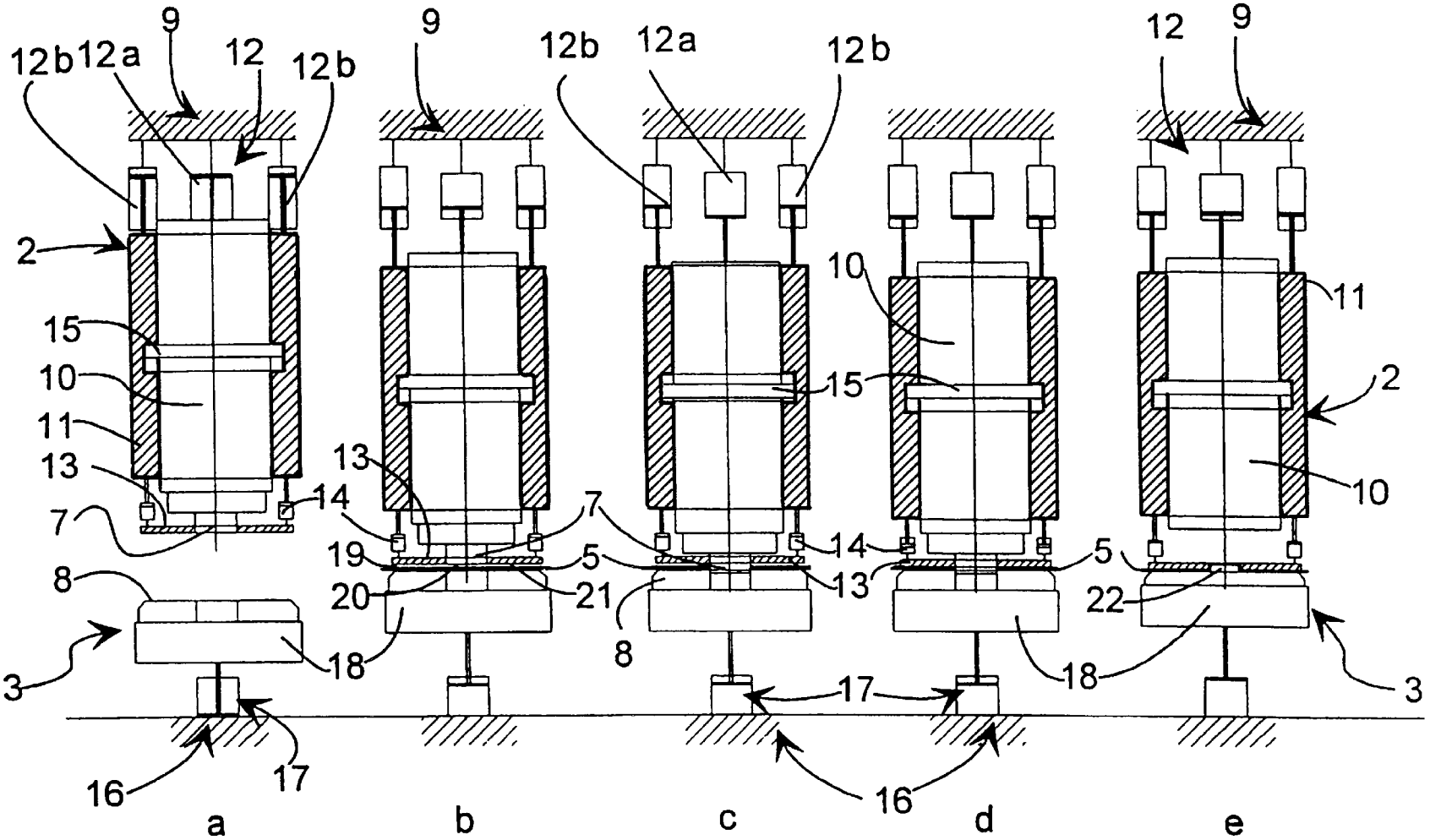
FIG. 2 is a schematic illustration of the principle of the invention, shown in steps a to e.

FIG. 2 shows steps a to e illustrating schematically some work stages to be conducted with the sheet metal work center. A punch stroke indicates in this context the work cycle of the buffer 10 and the upper tool 7, including the working operation and the return movement to the starting position.

FIG. 2*a* shows the buffer structure 2 and the stopper structure 3 in that drift exchange position, in which the upper tool 7 is exchanged in the buffer structure 2, and the releaser 13 and the stopper structure 3 in that position, in which the lower tool 8 is exchanged. The buffer structure 2 comprises as main parts a buffer fixing body 9, at which the buffer structure 2 is fixed to the machine body 1. Further, the buffer structure 2 comprises a buffer 10 and an auxiliary transfer body 11 effective outside the buffer 10, both being coupled to the buffer fixing body 9 by means of a transfer device 12. Furthermore, the lower part of the buffer structure 2 is provided with the upper tool 7 and the releasing plate or releaser 13 surrounding the upper tool 7 and being connected with the auxiliary transfer body 11 by means of the transfer device 14 of the releaser 13. Moreover, the buffer structure 2 comprises a locking arrangement 15 effective between the buffer 10 and the auxiliary transfer body 11, for locking the buffer 10 and the auxiliary transfer body 11 in relation to each other at certain work stages.

The transfer device 12 comprises as its first part a buffer transfer device 12*a*, effective between the buffer 10 and the buffer fixing body 9, and as its second part a transfer device 12*b* for the auxiliary transfer body 11, effective between the auxiliary transfer body 11 and the buffer fixing body 9.

The stopper structure 3 comprises as its main part a stopper fixing body 16, at which the stopper structure 3 is fixed to the machine body 1. The stopper structure 3 comprises a stopper transfer device 17 arranged to be movable in the vertical direction in relation to the stopper fixing body 16. The upper part of the stopper transfer device 17 is provided with the lower tool 8, fixed in a releasable manner with a tool fixing means 18.

FIG. 2*b* shows the starting position for a punching stroke, wherein the buffer 10 and the auxiliary transfer body 11 with the means connected to it are moved in connection with the sheet 5 in a way that the releaser is placed at a distance of air gap 19 from the top surface of the sheet 5. Thus the work levels 20, 21 of the upper tool 7 and the releaser 13 are substantially at the same level. At this stage, the control unit of the sheet metal work center can be used to make a selection between a so-called passive punching stroke, wherein the releaser will remain at the distance of said air gap 19 from the sheet 5, and a so-called active punching stroke, wherein the releaser 13 is brought into contact with the top surface of the sheet 5. The operations of this selection will be described in detail with reference to FIG. 6.

FIG. 2*c* shows the stage of making a passive punching stroke, wherein the transfer device 12*b* of the auxiliary transfer body is locked to be stationary in relation to the buffer fixing body 9 and the releaser 13 remains in its position, maintaining the distance of the air gap 19 to the sheet 5. The locking arrangement 15 effective between the buffer 10 and the auxiliary transfer body 11 is released, wherein the buffer transfer device 12*a* can conduct a downwards directed work movement in relation to the auxiliary transfer body 11 and the buffer fixing body 9.

FIG. 2*d*, in turn, shows the stage of making an active punching stroke, wherein the locking arrangement 15 between the buffer 10 and the auxiliary transfer body 11 is locked and the transfer device 12*b* of the auxiliary transfer body is released, wherein the unit comprising the buffer 10 and the auxiliary transfer body 11 with the means related to it can be moved downwards by the buffer transfer device 12*a*. When the releaser 13 meets the surface of the sheet 5, the releaser transfer device 14 will yield for the auxiliary transfer body 11, producing a counter-force for the release of the upper tool 7 at the end of the buffer 10. One function of the transfer device 14 of the releaser 13 is particularly to generate an adjustable releasing force. FIG. 2*d* shows a situation, in which the upper tool 7 has punched the sheet, penetrating under the upper surface of the lower tool 8 of the stopper structure 3 within the scope of the adjustable stroke length. FIG. 2*e*, in turn, shows the use of the sheet metal work center in forming, wherein the stopper structure 3 is used as the forming tool and the buffer structure 2 correspondingly as the stopper. Thus the upper tool 7 and the upper tool fixing means are removed from the buffer 10. The forming tool or the buffer 22 is fixed to the tool fixing device 18 in connection with the stopper structure 3. The releaser 13, or in this case the forming stopper, is lowered by using the second part 12*b* of the transfer device to the lowest position in connection with the sheet 5 to be worked, as shown in FIG. 2*e*, to effect a counterforce to the forming work. The releaser transfer device 14 is driven to a position in which the releaser transfer device 14 can yield in relation to the auxiliary transfer body in a direction perpendicular to the main level of the sheet to be worked.

In an advantageous embodiment, the buffer structure 2 is a substantially cylindrical form piece, wherein the buffer fixing body comprises a central hole, in which the substantially tubular auxiliary transfer body 11 is inserted. The buffer 10, in turn, has a primarily rod-like structure. All of the parts 9, 10 and 11 comprise constructive parts, which can be used to constitute the embodiment of buffer structure 2 shown in FIG. 7, using pressurized medium, particularly hydraulic fluid.

Figure 3:
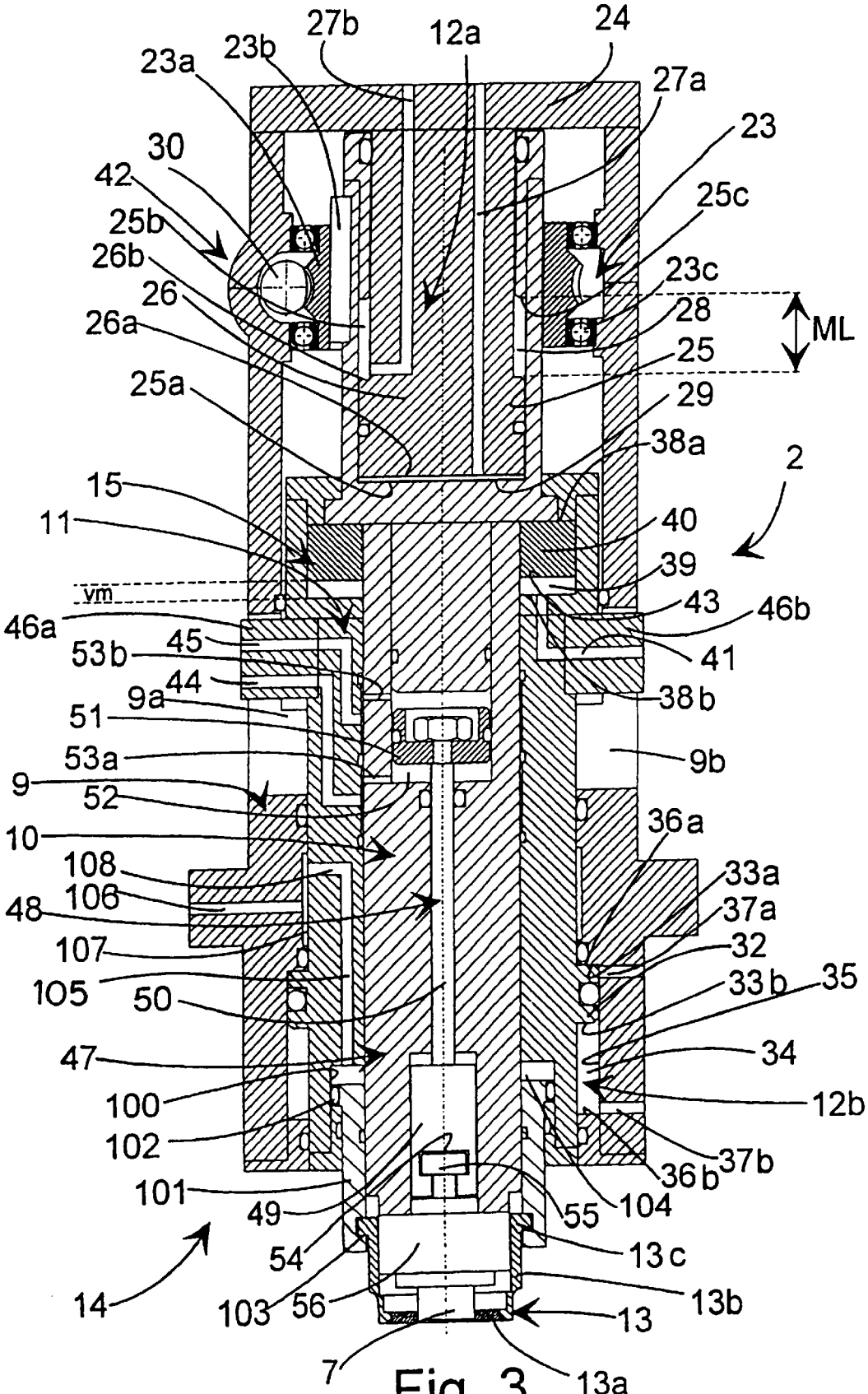
FIG. 3 illustrates an embodiment of the buffer structure in vertical cross-section.

With particular reference to FIG. 3, the buffer 10 is further arranged to be rotary around the central axle in alignment with the buffer structure by means of a rotating device 23 arranged in the upper part of the buffer structure 2. The buffer 10 is formed to have a hollow upper part comprising spaces 25*a*, 25*b* for pressurizing medium in a cylindrical hole 25 in the axial direction, wherein a stationary piston 26 fixed to the top cover 24 of the buffer fixing body 9 is placed in the hole 25. The top cover 24 is connected with a channel system 27*a* in the longitudinal direction of the piston 26, through which system the pressurized medium is led to the stationary piston 26 and further to the pressure space 25*a*, which is limited by the front surface 26*a* of the stationary piston 26 and the bottom 29 of the pressurized medium space 25*a*. A second channel system 27*b*, partly aligned with the stationary piston 26, is connected in the radial direction to the pressurized medium space 25*b* formed with the help of an insert 28. The above-mentioned structure constitutes a cylinder operating on the so-called differential principle. The length of the insert 28 (maximum distance between the radial surfaces 25*c* and 26*b*) in the longitudinal direction of the buffer 10 determines the maximum movement length ML of the buffer. The end surfaces of the insert 28 consist firstly of the radial surface 26*b* of the contraction of the stationary piston 26 and secondly of the radial surface 25*c* of the contraction of the hole.

On the outer surface of the buffer 10, between the buffer 10 and the buffer fixing body 9, a tooth wheel rim or a corresponding rotating means 23*a* is mounted on bearings 23*c*, driven by a worm pipe or a corresponding driving means 30, which in turn is mounted on bearings on the buffer fixing body 9. The above-mentioned gear arrangement, which in FIG. 3 is indicated with the reference numeral 42, is used to rotate the buffer 10 in relation to the buffer structure 2 around the vertical axle to achieve the desired angular position of the drift. The working movement of the buffer 10 is achieved by the pressurized medium supplied into the pressure space 25*a*, wherein the bush-like tooth wheel rim 23*a* surrounding the outer surface of the buffer 10 is arranged in relation to the fixing body 9 of the buffer 10 in a way that the necessary relative movement in the longitudinal direction of the buffer 10 takes place between the inner surface of the tooth wheel rim 23*a* and the outer surface of the upper part of the buffer 10 during working and return movements of the buffer 10 (surface 31). For transmission of the rotating force, a wedge part 23*b* is provided between the parts 10 and 23*a*. Thus, the unit presented above constitutes the transfer device 12*a* of the buffer 10 (FIG. 2).

In the lower part of the buffer structure 2, in turn, the transfer device 12*b* of the auxiliary transfer body 11 is arranged. It consists of an annular pressurized medium space 34 formed in the longitudinal direction of the buffer structure 2, between the auxiliary transfer body 11 and the buffer fixing body 9. Thus the outer surface of the auxiliary transfer body 11 is provided with an annular protruding flange 32, whose front surfaces 33*a*, 33*b* face said pressurized medium space 34. In a corresponding manner, the buffer fixing body 9 is provided with an outwards facing annular recess 35, whose front surfaces 36*a*, 36*b* face said pressurized medium space 34. The flange 32 is movable in the longitudinal direction of the buffer structure 2 in the recess 35. With the pressurized medium space 34, pressurized medium connectors, such as drillings or the like 37*a* and 37*b*, are provided, wherein the effect of the pressurized medium can be turned to the front surfaces 33*a*, 33*b* of the flange 32 in the auxiliary transfer body 11.

The locking arrangement 15 between the buffer 10 and the auxiliary transfer body 11 is formed after the buffer transfer device 12*a* in the longitudinal direction of the buffer. The buffer 10 is composed of two parts so that the circumference of its upper part is greater than the circumference of its lower part, wherein a radial front surface 38*a* is formed between said parts, forming part of the locking arrangement 15. In a corresponding manner, the auxiliary transfer body 11 is provided with an annular front surface 38*b* to make an annular pressurized medium space 39 in the axial direction. In the pressurized medium space 39, a rotary piston 40 is arranged, pressed on its axial surfaces on one hand against the outer surface of the lower part of the buffer 10 and on the other hand against the inner surface of the upper part of the auxiliary transfer body 11. The pressurized medium space 39 is connected via a pressurized medium connector 41 to the pressurized medium supply. In FIG. 3, the rotary piston 40 is shown in a position in which the buffer 10 is free to move the distance VM (free distance) in relation to the auxiliary transfer body 11. Thus the annular piston 40 is moved with the buffer 10, wherein the pressurized medium on the side of its front surface 43 is removed via the connector 41. This generates a downwards directed movement of the upper tool 7 in relation to the releaser 13. The lower part of the buffer 10 is equipped with a tool exchange mechanism which is generally indicated with the reference numeral 47. A tool locking mechanism 48 comprises the combination of a lower chuck 49, a rod 50 and a piston part 51. This combination is placed in corresponding cylindrical drillings in the buffer 10 in the longitudinal direction. The upper part of the locking mechanism 48 is placed in pressurized medium space 52, wherein the lower surface of the piston part 51 is provided with locking by the pressurized medium at a pressure effective through pressurized medium connector 53*a*, wherein the locking mechanism 48 moves to its upper position shown in FIG. 3. In a corresponding manner, when effective through pressurized medium connector 53*b*, the locking mechanism moves to its lower position in the longitudinal direction of the buffer 10, wherein the upper tool 7 can be exchanged. The auxiliary transfer body 11 is penetrated by pressurized medium channels 44 and 45, through which the pressurized medium is led to the pressurized medium connectors 53*a* and 53*b*, respectively. The pressurized medium channels 44 and 45, like the pressurized medium connector 41, are placed in projections 46*a* (parts 44 and 45) and 46*b* (part 41), which are placed in corresponding axial grooves 9*a* and 9*b*, respectively, in the buffer fixing body 9. The lower part of the lower chuck 49 of the locking mechanism 48 is provided with a recess 54 holding a fixing adapter 55, and this is connected with an intermediate adapter 56 underneath the fixing adapter 55 and within the sleeve-like releaser 13. The fixing adapter 55 comprises a rod part extending in the longitudinal direction of the buffer 10 and having on its outer surface a threading which is placed in the threaded hole in the upper tool 7, wherein the upper tool 7 can be tightened against the lower front surface of the intermediate adapter 56 (screwing not shown in FIG. 3).

FIG. 3 shows further the transfer device 14 of the releaser 13 whose general functions were described with reference to FIG. 2. The lower part of the auxiliary transfer body 11, the inner surface of its tubular form, is provided with a recess 100 in the longitudinal direction of the buffer structure. The buffer 10 is surrounded by the sleeve-like frame part 101 of the transfer device 14. The upper part of the frame part 101 is provided with a flange part 102 movable in the recess 100. The lower part of the frame part 101 contains a groove-like ring clip 103 inside the sleeve form for fixing the releaser 13. The releaser 13 consists of a releaser plate 13*a* parallel to the main level of the sheet to be worked, a sleeve-like releaser frame 13*b* adjacent to its outer edge in the axial direction, and a flange 13*c* protruding in the radial direction from the upper edge of the releaser frame and placed in the ring clip 103. The releaser 13 can, in connection with the exchange of the tool 7, be exchanged e.g. by a manipulator. The recess 100 forms a pressurized medium space 104, into which and from which the pressurized medium is led via a channel system 105 penetrating the auxiliary transfer body 11 to the pressurized medium connector 106 in the buffer fixing body 9. Between the buffer fixing body 9 and the buffer 10, an annular space 107 is formed in the longitudinal direction of the buffer structure 2, making it possible to maintain the pressurized medium connection between the pressurized medium connector 106 and the end 108 in connection with the annular space 107 of the channel system 105.

Figure 4:
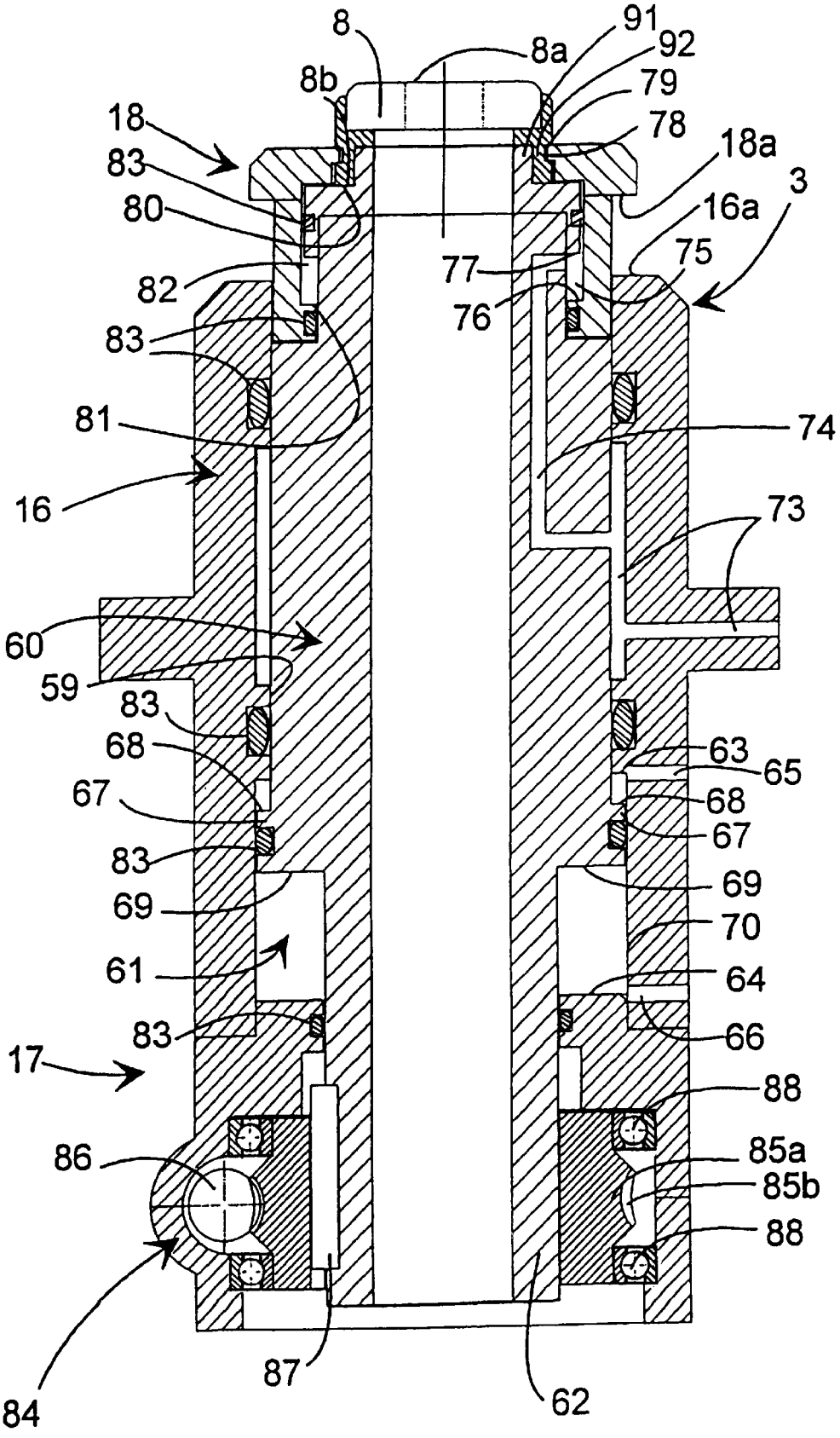
FIG. 4 shows the stopper structure in vertical cross-section.

With reference to FIG. 4, the stopper structure 3 comprises firstly a stopper fixing body 16, at which the stopper structure 3 is fixed to the machine body 1 of the sheet metal work center. The fixing body 16 has advantageously the form of a cylindrical piece, whose mantle 58 has inner or central hole 59 which holds the tool fixing body 60 which is hydraulically arranged to move, if necessary, in the longitudinal direction of the central hole 59 of the stopper fixing body 16 and in the vertical direction with the transfer device 17, particularly its hydraulic cylinder-piston combination 61 which is placed in the lower part of the stopper structure 3 as an extension of the tool fixing body 60. Both the tool fixing body 60 and the piston rod 62 of the transfer device 17 formed as an extension thereof are primarily hollow, tubular form pieces.

The upper part of the tool fixing body 60 is provided with the fixing device 18 of the lower tool or the stopper 8. When the sheet metal work center is used for forming, the lower tool is a buffer (cf. FIG. 2*e*).

In accordance with the invention, the tool fixing body 60, the lower tool 8 and the fixing device 18 can be placed by the cylinder-piston combination 61 in several height positions in relation to the stopper fixing body 16 and the working level 6 (cf. FIG. 1). In the lower position (situation A), the lower tool 8 is accessible in the so-called exchange position underneath the lower surface of the working level 6, wherein the lower tool 8 can be exchanged e.g. by a manipulator, or it can be serviced. Secondly, in the so-called middle position (situation B) the upper surface 8*a* of the lower tool 8 is substantially at the level of the upper surface of the working level 6 (cf. FIGS. 2*b–d*). Thus particularly the buffer structure 3 can be used for different forming operations, the lower tool 8 being the stopper. Thirdly (situation C), the lower tool can be used for forming work as shown in FIG. 2*e*, wherein the upper surface 8*a* of the buffer 8 used as the lower tool passes the upper surface of the working level 6 in the vertical direction. Fourthly, the cylinder-piston combination makes it possible to re-adjust the position of the lower tool 8, which is needed because of wearing and re-grinding, in a very simple way. Also the disadvantages of noise and vibration are reduced, because the working strokes have an impact on the hydraulic pressurized medium and not directly on the machine body.

The embodiment shown in FIG. 4 is formed in a way that the cylinder-piston combination 61 of the transfer device 17 comprises a recess 70 formed on the surface of the inner hole 59 of the stopper fixing body 16 in the longitudinal direction of the stopper structure 3. The ends 63, 64 of the recess 70 are provided with pressurized medium connectors 65, 66 penetrating the stopper fixing body 16. In the upper part of the piston rod 62, there is a flange 67 forming the actual piston, its radial front surfaces 68, 69 facing the ends 63 and 64. The area of the lower front surface 69 is greater than the area of the upper front surface 68, because a greater force is required upwards than downwards. Thus the diameter of the tool fixing body 60 can be greater than the diameter of the piston rod 62, wherein the flange 67 has a greater diameter than both the tool fixing body 60 and the piston rod 62.

The surfaces 64 and 69 are substantially close to or facing each other in the situation A. In the position shown in FIG. 4, i.e., when the flange 67 is at the middle section of the recess 70, the operation is either in situation B or moving to situation C, in which the surfaces 63 and 68 are substantially close to each other in a way that an excitation pressure space is left therebetween (as in situation A), as also when the surfaces 64 and 69 are close to each other.

When the surfaces 64 and 69 are approaching each other, i.e., when the operation is close to situation A, the fixing pressure is released from the pressurized medium space 75 through the pressurized medium channel system 73 in the stopper fixing body 16 and through the pressure channel system 74 in the tool fixing body. A mechanical contact is formed between a lockpin cam 78 and the stopper fixing body 16 (surfaces 16*a* and 18*a*, i.e. the upper front surface of part 16 and the lower surface of the flange part of part 18), wherein the fastening of the lower tool 8 is detached between the outer surface of an axial projection 91 on the tool fixing body 60 and the inner hole 92 in the lower tool 8. The pressure channel system 74 is connected with the pressurized medium space 75 which is effective between the tool fixing body 60 and the tool fixing device 18 and is used for the hydraulic locking of the lower tool 8 in connection with the stopper structure 3.

At this stage, the front surfaces 76 and 77 (the lower front surface 76 in the tool fixing device 18 and the upper front surface 77 in the tool fixing body 60) are moved in the axial direction (against each other in the longitudinal direction of the stopper structure 3) and the volume of the pressurized medium space 75 is reduced to the excitation volume. Thus the locking of the lower tool 8 is released, and it can be detached in the lateral direction (perpendicular to the main level of FIG. 6) from the retaining structure of the lockpin cam 78 (in the fixing device 18) and the groove 79 (in the lower tool 8) for example manually or by using a manipulator. After the exchange of the lower tool 8, the tool fixing body 60 is moved upwards by using the cylinder-piston combination 61, wherein by using the pressurized medium connection between the parts 73 and 74, the pressurized medium space 75 is pressurized during the relative movement between the parts 16 and 60, wherein the pressurized medium fills up and thereby enlarges the pressurized medium space 75. The mechanical contact between the parts 16 and 18 is maintained, until there is a mechanical contact between the surfaces 8*b* and 80. The lower tool 8 is locked by an axial force effective between the upper front surface 80 of the tool fixing body 60 and the lower front surface 8*b* of the lower tool 8 from the pressurized medium space 75. The force between the surfaces 8*b* and 80 is transferred via the lockpin cam-groove structure 78, 79.

In structural respects, the pressurized medium space 75 is formed into the inner hole 81 of the bush-like fixing device 18 of the lower tool 8 as a recess 82 having the above-mentioned radial front surface 76. In a corresponding manner, the outer surface of the tool fixing body 60 is provided with a recess whose upper radial front surface is the above-mentioned front surface 77.

In the lower part of the stopper structure 3, between the stopper fixing body 16 and the piston rod 62, a device 84 is placed for rotating the lower tool 8, being part of the transfer device 17, wherein the piston rod 62 is surrounded by a bush-like tooth wheel rim or a corresponding rotary means 85, mounted on bearings 88 in the stopper fixing body 16. A driving means, such as a worm pipe 86, for driving the tooth wheel rim 85 is mounted on bearings on the stopper fixing body 16. The tooth wheel rim 85 is coupled to be dead in relation to the piston rod 62 with a sliding key 87 which makes possible the axial movement of the rotating device 84 and the piston rod 62 in relation to each other in the longitudinal direction of the piston rod 62. The rotating device 84, which is substantially similar to the rotating device 23 in the buffer 10 and also driven with an electric engine (not shown in the figures), is driven to bring the lower tool 8 used at the time to the desired working position in the radial direction of the lower tool.

FIG. 4 shows a group of packings 83 which are naturally needed between constructively movable parts in hydraulic applications.

Figure 5:
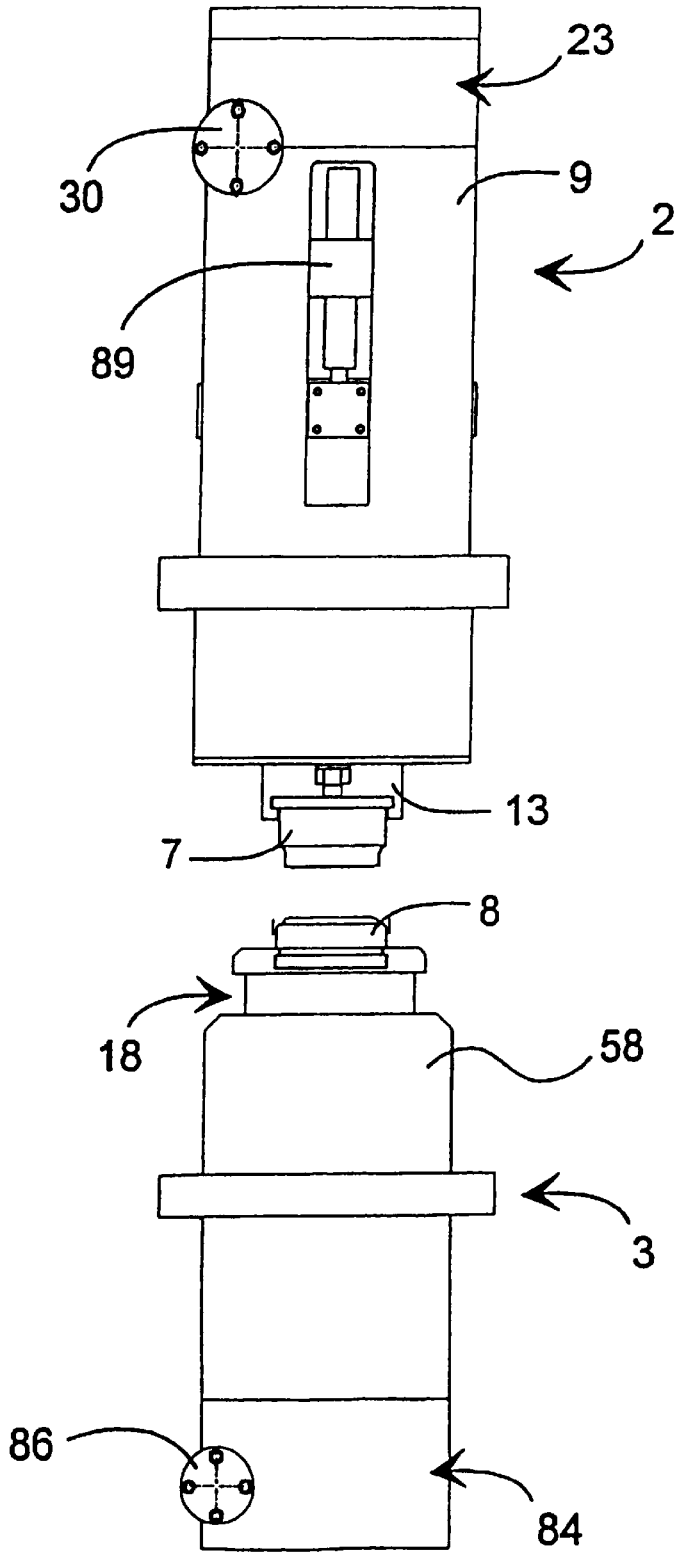
FIG. 5 shows the buffer and stopper structures seen from the side.

FIG. 5 shows the parts corresponding to the structures of FIGS. 3 and 4 seen from the side and indicated with the reference numerals of FIGS. 3 and 4 for the respective structural parts. In FIG. 5, the reference numeral 89 indicates the position detector of the auxiliary transfer body.

Figure 6:
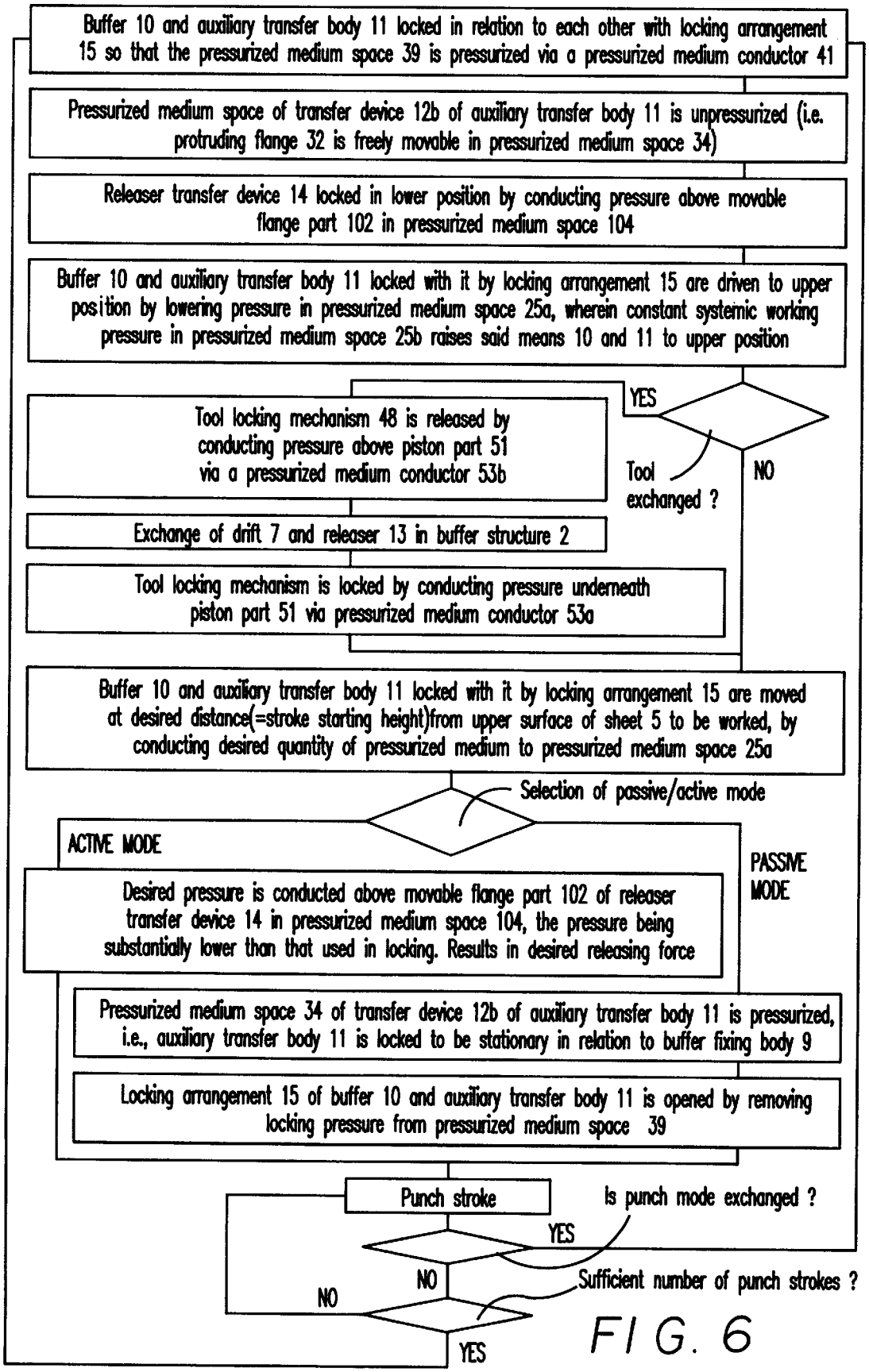
FIG. 6 is a flow chart illustrating the operating principle of the buffer structure.

FIG. 6 is a flow chart showing the operating principle of the buffer structure and the selection between active and passive mode, with brief explanations. The flow chart clarifies and supplements the description presented above.

Figure 7:
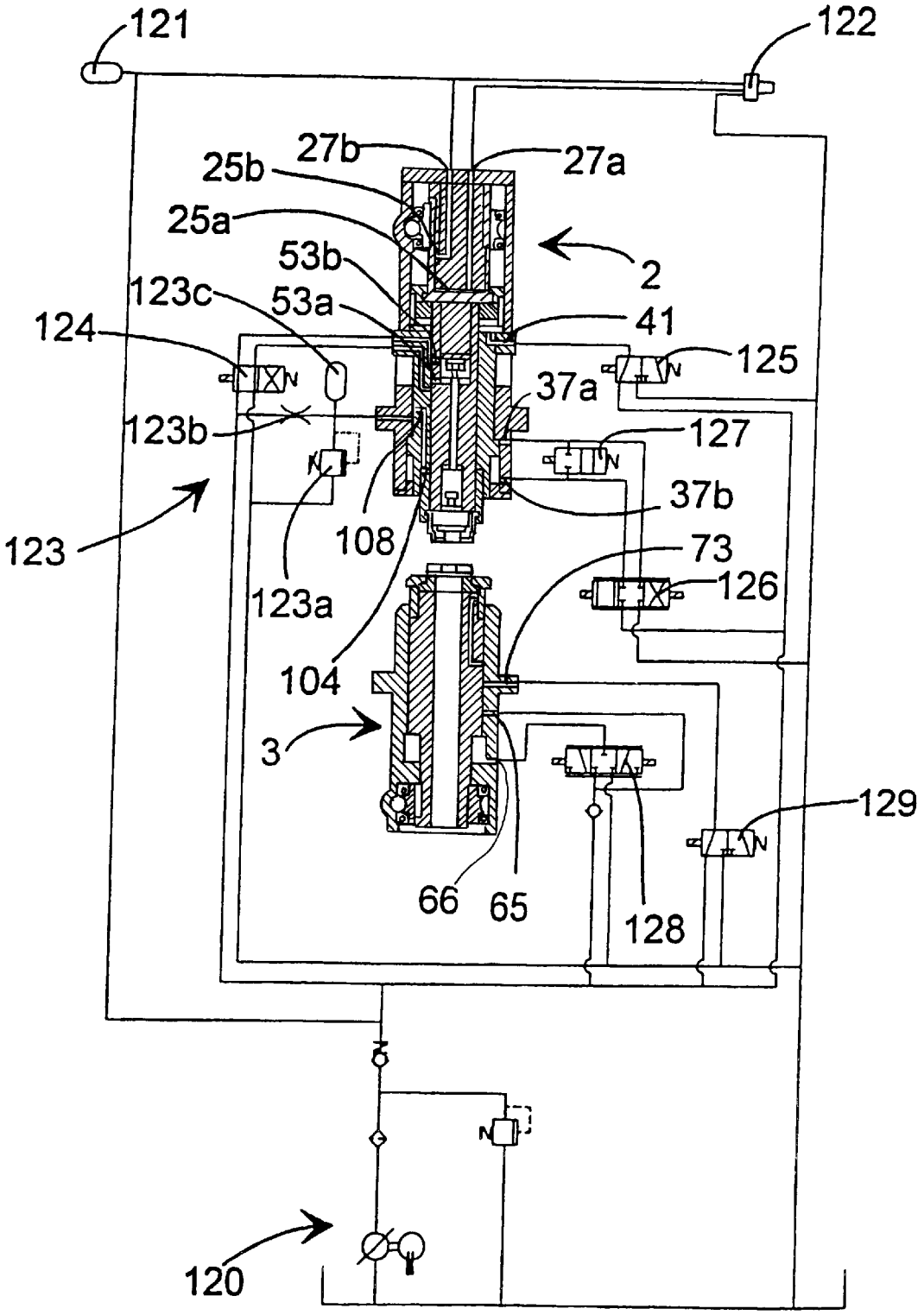
FIG. 7 is a hydraulic chart for using the buffer and stopper structures.

Further, FIG. 7 is a diagram showing the hydraulic control system of the pressurized medium in the buffer and stopper structures. In FIG. 7, the reference numerals used indicate the same parts as before, where applicable. In this respect, reference is made to the above description.

The hydraulic system of FIG. 7 comprises a driving aggregate 120 for producing the hydraulic pressure in the system. The aggregate is connected via normal hydraulic pipes to the valves controlling the actuators valve 124 for tool change and valve 125 for the locking arrangement.

The system comprises a hydraulic accumulator 121 and a servo valve 122 controlling the buffer 10. The actual punching operation is effected by a differential cylinder used as the transfer device 12*a* of the buffer 10 and comprising parts 25*a*, 25*b*, 27*a*, 27*b* and 122. For the operation of the differential cylinder, it is essential that the pressurized medium space 25*b* is always under systemic pressure and the pressurized medium space 25*a* is under the pressure corresponding to a balanced situation. The pressure in the pressurized medium space 25*a* is controlled with the servo valve 122.

The system comprises further a releasing force control system 123, consisting of pressure control valve 123*a*, venturi 123*b* and hydraulic accumulator 123*c*. The purpose of the control system 123 is to control the releasing force when operating in the active mode. The pressure control valve 123*a* is used to adjust the pressure setting value of the pressure space 104. The releasing force is directly proportional to the pressure in the pressure space 104. By means of the venturi 123*b* and the hydraulic accumulator 123*c*, the pressure in the pressure space 104 is kept constant irrespective of the volume of the pressure space 104.

Valves 126 and 127 are used for controlling the operation of the auxiliary transfer body 11. Using a free circulation valve 127, the pressurized medium connectors 37*a* and 37*b* can be connected with each other, wherein the auxiliary transfer body 11 is released in the active mode. When the free circulation valve 127 is in a position that there is no pressurized medium connection between the pressurized medium connectors 37*a* and 37*b*, the position of the auxiliary transfer body 11 can be guided with a directing valve 126.

A directing valve 128 controls via the pressurized medium connectors 65 and 66 the cylinder-piston combination 61 in the stopper 3. Further, a directing valve 129 controls the pressurized medium space 75 through pressurized medium channel systems 73 and 74.

We claim:

1. A sheet metal work center comprising:

a body;

a work table whereon a sheet to be worked is placed;

means for holding and moving said sheet for work processing;

upper and lower tools for respectively impacting said sheet at its opposite sides;

a releaser means positioned relative to said upper tool;

a locking arrangement being placed between said upper tool and said releaser means;

a transfer device for moving said upper tool and said releaser means in the vertical direction, said transfer device being arranged to have two parts;

wherein, when said sheet metal work center operates in a passive mode, said releaser means is positioned a certain distance from the surface of said sheet, and the movements of said upper tool and said releaser means are made with said locking arrangement locked and with either part of said transfer device being used; and wherein when said sheet metal work center operates in an active mode, said releaser means is in contact with the surface of said sheet, and the movements of said upper tool and said releaser means are made with said locking arrangement locked and with either part of said transfer device being used.

2. Sheet metal work center according to claim 1, wherein the operation of said upper tool is conducted with said locking arrangement released and a first part of said transfer device being used, and said releaser means being kept at its position by a second part of said transfer device.

3. Sheet metal work center of claim 1, wherein the operation of said lower tool is conducted with said locking arrangement released, said releaser means being kept at its position by a second part of said transfer device, and said lower tool being driven to impact said sheet to effect forming thereto.

4. Sheet metal work center comprising:

a body;

a work table whereon a sheet to be worked is placed;

means for holding and moving said sheet;

upper and lower tools for respectively impacting opposite sides of said sheet;

a releaser means positioned relative to said upper tool;

a transfer device for moving said upper tool and said releaser means in the vertical direction, said transfer device having two parts; and a locking arrangement placed between said upper tool and said releaser means;

wherein at least part of the vertical movements of said upper tool and said releaser means is implemented by using a part of said transfer device, said upper tool and said releaser means being connected with said locking arrangement.

5. Sheet metal center according to claim 4, wherein said sheet metal center is adaptable to operate in an active mode and a passive mode, said releaser means being positioned a given distance from the surface of said sheet and said locking arrangement being locked so that the movements of said upper tool and said releaser means are driven by either part of said transfer device when said sheet metal work center operates in said passive mode, and said releaser means being in contact with the surface of said sheet and said locking arrangement being locked so that the movements of said upper tool and said releaser means are driven by either part of said transfer device when said sheet metal work center operates in said active mode.

6. Sheet metal work center of claim 4, wherein the operation of said lower tool is conducted with said locking arrangement released, said releaser means being kept at its position by a second part of said transfer device, and said lower tool being driven to impact said sheet to effect forming thereto.

7. Sheet metal work center according to claim 4, wherein said upper tool and said releaser means are placed in a buffer structure having a buffer fixing body, said buffer structure being mounted in said body of the sheet metal work center.

8. Sheet metal work center according to claim 4, wherein said transfer device comprises two parts, the first part of said transfer device being placed between a buffer, to which said upper tool is fixed, and a buffer fixing body, and the second part of said transfer device being placed between an auxiliary transfer device, to which said releaser means is fixed, and said buffer fixing body.

9. Sheet metal work center according to claim 8, wherein said buffer fixing body is a substantially tubular form piece having positioned therein a substantially tubular auxiliary transfer device, said buffer being inserted inside said auxiliary transfer device; and wherein said transfer device is adapted to conduct relative movements between said buffer fixing body, said auxiliary transfer device and said buffer in the longitudinal direction of a buffer structure.

10. Sheet metal work center according to claim 9, wherein said locking arrangement is placed between the inner surface of said auxiliary transfer device and the outer surface of said buffer.

11. Sheet metal work center according to claim 8, wherein said locking arrangement comprises:

an annular pressurized medium space formed between said auxiliary transfer device and said buffer, said pressurized medium space holding a rotary piston whose first radial surface faces the front surface of said pressurized medium space in connection with said buffer and whose second radial surface faces the front surface of said pressurized medium space in connection with said auxiliary transfer device, wherein when the medium is pressurized between said auxiliary transfer device and said second radial surface of said rotary piston, the moves of said auxiliary transfer device being locked to said buffer, the front surface being in connection with said buffer and in a power transmission connection to the first radial surface of said rotary piston when the first part of said transfer device is in operation.

12. Sheet metal work center according to claim 8, further comprising:

an arrangement to be used as the second part of said transfer device, wherein said buffer fixing body has an inner surface provided with a recess in the longitudinal direction of a buffer structure to which said buffer resides; and wherein the outer surface of said auxiliary transfer device being provided with a protruding flange to be placed in the recess, and said buffer fixing body being provided with pressurized medium connectors for directing the effect of the pressurized medium on opposite front surfaces of said flange.

13. Sheet metal work center according to claim 8, wherein said upper tool is positioned in a buffer structure, further comprising:

a releaser transfer device placed between said auxiliary transfer device and said releaser means for moving said releaser means in the longitudinal direction of said buffer structure in relation to said auxiliary transfer device.

14. Sheet metal work center according to the claim 13, wherein said releaser transfer device comprises a sleeve-like frame part surrounding said buffer, its lower part being provided with a clip for removably fixing said releaser means to a frame part and its upper part being provided with a protruding flange part placed in the recess forming the pressurized medium space in the auxiliary transfer device, wherein a channel system penetrating the auxiliary transfer device and being in connection with the pressurized medium connector in the buffer fixing body is connected with the recess.

15. Sheet metal work center according to claim 8, wherein a first part of said transfer device is placed in the upper part of a buffer structure, and a second part of the transfer device is placed in the lower part of said buffer structure.

* * * * *